US007467944B2

(12) United States Patent
Furner

(10) Patent No.: US 7,467,944 B2
(45) Date of Patent: Dec. 23, 2008

(54) CANDLE ASSEMBLY INCLUDING A FUEL ELEMENT AND A WICK HOLDER

(75) Inventor: Paul E. Furner, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 539 days.

(21) Appl. No.: 11/199,669

(22) Filed: Aug. 9, 2005

(65) Prior Publication Data

US 2005/0271994 A1 Dec. 8, 2005

Related U.S. Application Data

(63) Continuation-in-part of application No. 10/780,028, filed on Feb. 17, 2004, now Pat. No. 7,247,017.

(51) Int. Cl.
*F23D 3/16* (2006.01)

(52) U.S. Cl. ..... 431/289; 431/292; 431/298

(58) Field of Classification Search ..... 431/298, 431/292, 289, 126
See application file for complete search history.

(56) References Cited

U.S. PATENT DOCUMENTS

| | | | | |
|---|---|---|---|---|
| 213,184 | A | 3/1879 | Frick | |
| 405,786 | A | 6/1889 | Ludde | |
| 407,051 | A | 7/1889 | Baumer | |
| 408,973 | A | 8/1889 | Heller | |
| 484,210 | A | 10/1892 | Ludde | |
| 779,644 | A | 1/1905 | Ferrier | |
| 837,240 | A | 11/1906 | Mulkerins | |
| 1,044,256 | A | 11/1912 | Satter | |
| D43,845 | S | 4/1913 | Hirschfeld | |
| 1,195,657 | A | 8/1916 | Chersky | |
| D49,902 | S | 11/1916 | Labaree et al. | |
| 1,226,850 | A | 5/1917 | Booty | |
| 1,229,140 | A | 6/1917 | Ritter | |
| 1,267,968 | A * | 5/1918 | Bulle | 431/289 |
| 1,309,545 | A | 7/1919 | Reicher | |
| 1,316,624 | A | 9/1919 | Lucas | |
| 1,320,109 | A | 10/1919 | Wooster | |
| 1,336,635 | A | 4/1920 | Knapp | |
| 1,344,446 | A | 6/1920 | Engman | |
| 1,390,389 | A | 9/1921 | Rosenfeld | |
| 1,484,964 | A | 2/1924 | Benneville | |
| D67,108 | S | 4/1925 | Steeple | |

(Continued)

FOREIGN PATENT DOCUMENTS

| | | |
|---|---|---|
| CA | 2208145 | 12/1998 |

(Continued)

OTHER PUBLICATIONS

International Candle House catalog (1966-67); Bobeshes pp. 54-55.

(Continued)

*Primary Examiner*—Alfred Basichas

(57) ABSTRACT

A melting plate candle assembly includes a wick holder that retains a wick spaced above a melting plate and a base portion having one or more capillary paths disposed therein that are adapted to draw liquid, such as melted candle wax, from a pool retained on the melting plate to the wick by capillary action therein.

7 Claims, 3 Drawing Sheets

U.S. PATENT DOCUMENTS

| | | | | | |
|---|---|---|---|---|---|
| 1,640,734 | A | | 8/1927 | Smith | |
| D75,463 | S | | 6/1928 | Bach | |
| D80,971 | S | | 4/1930 | Sakier | |
| D83,100 | S | | 1/1931 | Gisolfi | |
| D110,902 | S | | 8/1938 | Loesch | |
| D119,587 | S | | 3/1940 | Fuerst | |
| 2,234,903 | A | | 3/1941 | Muench | |
| 2,237,523 | A | | 4/1941 | Damon | |
| 2,246,346 | A | | 6/1941 | Wells | |
| 2,254,906 | A | | 9/1941 | Petrulis | |
| 2,324,753 | A | | 7/1943 | Alexiade | |
| 2,354,343 | A | | 7/1944 | Webber et al. | |
| 2,393,767 | A | | 1/1946 | Gould | |
| 2,462,440 | A | | 2/1949 | Tierney | |
| 2,494,995 | A | | 1/1950 | Gardner | |
| 2,713,256 | A | | 7/1955 | Oesterle | |
| 2,758,460 | A | | 8/1956 | Ciano | |
| 2,775,006 | A | | 12/1956 | Kranc | |
| 2,809,512 | A | | 10/1957 | Hartnett | |
| RE24,423 | E | | 2/1958 | Oesterle et al. | |
| 3,121,316 | A | | 2/1964 | Wilson | |
| D206,946 | S | | 2/1967 | Knodt | |
| D208,064 | S | | 7/1967 | Quistgaard et al. | |
| D208,097 | S | | 7/1967 | Henn | |
| 3,462,235 | A | | 8/1969 | Summers | |
| 3,565,281 | A | | 2/1971 | Collie | |
| D226,240 | S | | 1/1973 | Twedt | |
| 3,730,674 | A | * | 5/1973 | Gross | 431/288 |
| 3,741,711 | A | | 6/1973 | Bryant | |
| 3,749,904 | A | | 7/1973 | Graff | |
| 3,762,857 | A | | 10/1973 | Andeweg | |
| D229,852 | S | | 1/1974 | Lindblad | |
| 3,790,332 | A | * | 2/1974 | Woollard | 431/126 |
| 3,818,439 | A | * | 6/1974 | Maine | 340/331 |
| D236,064 | S | | 7/1975 | Balbo | |
| 3,898,039 | A | | 8/1975 | Lin | |
| 3,910,753 | A | * | 10/1975 | Lee | 431/290 |
| 3,932,113 | A | | 1/1976 | Thrush | |
| 3,994,502 | A | | 11/1976 | Lombardi | |
| 4,013,397 | A | | 3/1977 | Neugart | |
| 4,019,856 | A | | 4/1977 | Lacroix | |
| D247,635 | S | | 3/1978 | Maxwell | |
| D248,499 | S | | 7/1978 | Ulrich et al. | |
| D248,500 | S | | 7/1978 | Ulrich et al. | |
| 4,102,634 | A | | 7/1978 | Crisp | |
| D248,787 | S | | 8/1978 | Ulrich et al. | |
| D248,788 | S | | 8/1978 | Ulrich et al. | |
| D248,789 | S | | 8/1978 | Ulrich et al. | |
| 4,134,718 | A | | 1/1979 | Kayfetz et al. | |
| D253,432 | S | | 11/1979 | Van Koert | |
| D253,732 | S | | 12/1979 | Van Koert | |
| 4,185,953 | A | | 1/1980 | Schirneker | |
| 4,206,500 | A | | 6/1980 | Neil | |
| 4,206,560 | A | | 6/1980 | Sefried, II | |
| 4,224,017 | A | | 9/1980 | Kayne | |
| D264,385 | S | | 5/1982 | Meyer | |
| 4,332,548 | A | | 6/1982 | Linton et al. | |
| 4,381,914 | A | * | 5/1983 | Ferguson | 431/267 |
| 4,427,366 | A | | 1/1984 | Moore | |
| 4,477,249 | A | | 10/1984 | Ruzek et al. | |
| 4,524,408 | A | | 6/1985 | Minera | |
| 4,551,794 | A | | 11/1985 | Sandell | |
| 4,557,687 | A | * | 12/1985 | Schirneker | 431/291 |
| 4,568,269 | A | | 2/1986 | Lin | |
| 4,568,270 | A | | 2/1986 | Marcus et al. | |
| 4,588,618 | A | | 5/1986 | Wolfe | |
| D292,525 | S | | 10/1987 | Van Deelen | |
| 4,755,135 | A | | 7/1988 | Kwok | |
| 4,781,895 | A | | 11/1988 | Spector | |
| 4,804,323 | A | | 2/1989 | Kim | |
| D312,507 | S | | 11/1990 | Thoreson | |
| 4,983,119 | A | | 1/1991 | Lin | |
| 5,015,175 | A | | 5/1991 | Lee | |
| D320,266 | S | | 9/1991 | Kunze | |
| 5,069,617 | A | | 12/1991 | Lin | |
| 5,078,591 | A | | 1/1992 | Depres | |
| 5,078,945 | A | | 1/1992 | Byron | |
| 5,086,380 | A | | 2/1992 | Hedner, Jr. | |
| D325,077 | S | | 3/1992 | Kearnes | |
| 5,101,328 | A | | 3/1992 | Hai | |
| 5,174,645 | A | | 12/1992 | Chung | |
| 5,193,994 | A | | 3/1993 | Schirneker | |
| 5,338,187 | A | | 8/1994 | Elharar | |
| 5,363,590 | A | | 11/1994 | Lee | |
| D355,266 | S | | 2/1995 | Caplette et al. | |
| D356,472 | S | | 3/1995 | Jaworski | |
| 5,425,633 | A | * | 6/1995 | Cole | 431/291 |
| D360,461 | S | | 7/1995 | Gillespie | |
| D369,871 | S | | 5/1996 | Lui | |
| D371,212 | S | | 6/1996 | Hardy et al. | |
| D376,002 | S | | 11/1996 | Upson | |
| D377,402 | S | | 1/1997 | Perkins | |
| D383,944 | S | | 9/1997 | Lillelund et al. | |
| 5,690,484 | A | | 11/1997 | Leonard et al. | |
| D390,676 | S | | 2/1998 | Hollington | |
| D391,119 | S | | 2/1998 | Rapaz | |
| D393,910 | S | | 4/1998 | Chambers et al. | |
| D394,513 | S | | 5/1998 | Davis | |
| 5,797,739 | A | | 8/1998 | Lioi | |
| 5,807,096 | A | | 9/1998 | Shin et al. | |
| D399,298 | S | | 10/1998 | Whitehead | |
| 5,840,246 | A | | 11/1998 | Hammons et al. | |
| 5,842,850 | A | * | 12/1998 | Pappas | 431/291 |
| 5,843,194 | A | | 12/1998 | Spaulding | |
| 5,871,553 | A | | 2/1999 | Spaulding | |
| D410,756 | S | | 6/1999 | Kleinberg | |
| 5,909,845 | A | * | 6/1999 | Greatbatch et al. | 239/44 |
| 5,921,767 | A | | 7/1999 | Song | |
| 5,927,959 | A | | 7/1999 | Johnson | |
| 5,939,005 | A | | 8/1999 | Materna | |
| 5,951,278 | A | | 9/1999 | Young et al. | |
| 5,955,034 | A | | 9/1999 | Zaunbrecher et al. | |
| 5,955,958 | A | | 9/1999 | Lu | |
| 5,961,967 | A | | 10/1999 | Powell et al. | |
| D416,099 | S | | 11/1999 | Hardy | |
| D416,341 | S | | 11/1999 | Allen | |
| 5,980,241 | A | | 11/1999 | Schirneker | |
| 6,019,804 | A | | 2/2000 | Requejo et al. | |
| 6,033,209 | A | | 3/2000 | Shin et al. | |
| D422,180 | S | | 4/2000 | Sundberg | |
| 6,050,812 | A | | 4/2000 | Chuang | |
| D425,220 | S | | 5/2000 | Klett et al. | |
| D425,636 | S | | 5/2000 | Freeman | |
| 6,059,564 | A | | 5/2000 | Morris | |
| 6,062,847 | A | | 5/2000 | Pappas | |
| 6,068,472 | A | | 5/2000 | Freeman et al. | |
| D426,902 | S | | 6/2000 | Hardy et al. | |
| 6,074,199 | A | | 6/2000 | Song | |
| 6,079,975 | A | | 6/2000 | Conover | |
| 6,090,331 | A | * | 7/2000 | Schwarz et al. | 264/405 |
| 6,099,877 | A | | 8/2000 | Schuppan | |
| D430,943 | S | | 9/2000 | Zutler | |
| D433,168 | S | | 10/2000 | Cousins | |
| 6,129,771 | A | | 10/2000 | Ficke et al. | |
| 6,152,728 | A | | 11/2000 | Griffel | |
| D435,100 | S | | 12/2000 | Pesu et al. | |
| D436,415 | S | | 1/2001 | Hardy | |
| 6,214,063 | B1 | | 4/2001 | DeStefano et al. | |
| D443,080 | S | | 5/2001 | Klett et al. | |
| D443,081 | S | | 5/2001 | Klett et al. | |
| D443,082 | S | | 5/2001 | Klett et al. | |
| D443,101 | S | | 5/2001 | Williamson | |
| 6,231,336 | B1 | | 5/2001 | Chen | |
| 6,241,362 | B1 | | 6/2001 | Morrison | |

| | | | | |
|---|---|---|---|---|
| 6,241,513 | B1 | 6/2001 | Jeneral | |
| D445,030 | S | 7/2001 | Croft et al. | |
| D445,337 | S | 7/2001 | Croft et al. | |
| 6,267,584 | B1 | 7/2001 | Zou | |
| 6,270,339 | B1 | 8/2001 | Zou | |
| 6,273,710 | B1 | 8/2001 | Zou | |
| 6,276,925 | B1 | 8/2001 | Varga | |
| D447,418 | S | 9/2001 | Bezek et al. | |
| 6,290,489 | B1 | 9/2001 | Seidler | |
| D448,867 | S | 10/2001 | Manocheo et al. | |
| 6,296,477 | B1 | 10/2001 | Lin | |
| 6,299,435 | B1 | 10/2001 | Freeman et al. | |
| D450,395 | S | 11/2001 | Bellenger | |
| D450,865 | S | 11/2001 | Bellenger et al. | |
| 6,328,935 | B1 | 12/2001 | Buccellato | |
| 6,361,311 | B1 | 3/2002 | Smith | |
| D455,486 | S | 4/2002 | Makino | |
| D455,846 | S | 4/2002 | Araujo | |
| D456,539 | S | 4/2002 | Leeds | |
| 6,371,756 | B1 | 4/2002 | Toohey | |
| D459,498 | S | 6/2002 | Araujo | |
| 6,398,544 | B2 * | 6/2002 | Wright et al. | 431/291 |
| D461,916 | S | 8/2002 | Araujo | |
| D462,132 | S | 8/2002 | Papai | |
| 6,428,311 | B1 | 8/2002 | Bernardo | |
| 6,439,471 | B2 | 8/2002 | Ehrlich et al. | |
| D462,793 | S | 9/2002 | Freeman et al. | |
| 6,450,802 | B1 | 9/2002 | Steck | |
| 6,454,561 | B1 * | 9/2002 | Colthar et al. | 431/289 |
| D464,745 | S | 10/2002 | Mangini et al. | |
| 6,468,071 | B2 | 10/2002 | Zoy | |
| D465,587 | S | 11/2002 | Papai | |
| D466,236 | S | 11/2002 | Papai | |
| 6,482,365 | B1 * | 11/2002 | Soller | 422/126 |
| 6,488,494 | B2 | 12/2002 | Lee | |
| 6,491,516 | B1 | 12/2002 | Tal et al. | |
| D469,550 | S | 1/2003 | Moeller | |
| 6,503,459 | B1 * | 1/2003 | Leonard et al. | 422/125 |
| 6,508,644 | B1 * | 1/2003 | Pesu et al. | 431/35 |
| D469,893 | S | 2/2003 | Shen | |
| 6,520,770 | B2 | 2/2003 | Zou | |
| D471,299 | S | 3/2003 | Papai | |
| 6,531,063 | B1 | 3/2003 | Rose | |
| 6,537,063 | B1 | 3/2003 | Pecoskie | |
| 6,543,268 | B2 | 4/2003 | Wright et al. | |
| 6,544,302 | B2 | 4/2003 | Berger et al. | |
| 6,551,365 | B2 | 4/2003 | Berger et al. | |
| 6,554,448 | B2 | 4/2003 | Carpenter et al. | |
| D474,854 | S | 5/2003 | Lam | |
| 6,568,934 | B1 | 5/2003 | Butler | |
| RE38,150 | E * | 6/2003 | Greatbatch et al. | 239/44 |
| 6,575,613 | B2 | 6/2003 | Brown et al. | |
| 6,579,089 | B1 | 6/2003 | Iu | |
| 6,592,637 | B2 | 7/2003 | McGee et al. | |
| 6,595,771 | B2 | 7/2003 | Chu | |
| 6,616,308 | B2 | 9/2003 | Jensen et al. | |
| D481,143 | S | 10/2003 | McMinn | |
| D481,473 | S | 10/2003 | Walsh | |
| 6,630,110 | B2 | 10/2003 | Urfig | |
| 6,648,631 | B2 * | 11/2003 | Wright et al. | 431/291 |
| 6,663,838 | B1 * | 12/2003 | Soller et al. | 422/125 |
| D485,624 | S | 1/2004 | Kitamura | |
| 6,688,880 | B1 | 2/2004 | Pangle | |
| 6,695,611 | B2 * | 2/2004 | Lee | 431/293 |
| D487,687 | S | 3/2004 | Shields, Jr. | |
| 6,709,266 | B2 | 3/2004 | Jensen | |
| 6,730,137 | B2 | 5/2004 | Pesu et al. | |
| 6,733,279 | B2 | 5/2004 | Thigpen et al. | |
| D491,288 | S | 6/2004 | Young | |
| D493,548 | S | 7/2004 | Goldman | |
| D495,437 | S | 8/2004 | Barbera | |
| D495,438 | S | 8/2004 | Barbera et al. | |
| 6,769,905 | B2 | 8/2004 | Gray et al. | |
| 6,780,382 | B2 * | 8/2004 | Furner et al. | 422/126 |
| D497,680 | S | 10/2004 | McMinn | |
| 6,802,707 | B2 | 10/2004 | Furner | |
| 6,808,388 | B2 | 10/2004 | Lee | |
| 6,849,240 | B2 | 2/2005 | Nakatsu et al. | |
| 6,857,869 | B1 | 2/2005 | Sun | |
| 6,863,525 | B2 | 3/2005 | Byrd | |
| 6,923,639 | B2 | 8/2005 | Pesu et al. | |
| 7,247,017 | B2 * | 7/2007 | Furner | 431/292 |
| 2001/0012495 | A1 * | 8/2001 | Furner et al. | 422/126 |
| 2001/0031438 | A1 | 10/2001 | Hannington et al. | |
| 2002/0066789 | A1 | 6/2002 | Yen | |
| 2002/0068009 | A1 | 6/2002 | Laudamiel-Pellet | |
| 2002/0068010 | A1 | 6/2002 | Laudamiel-Pellet | |
| 2002/0093834 | A1 | 7/2002 | Yu | |
| 2002/0102187 | A1 | 8/2002 | Bellenger et al. | |
| 2002/0119413 | A1 | 8/2002 | Cheng | |
| 2002/0127507 | A1 | 9/2002 | Long | |
| 2002/0166863 | A1 * | 11/2002 | Wright et al. | 220/600 |
| 2003/0027091 | A1 | 2/2003 | Brandt | |
| 2003/0064336 | A1 | 4/2003 | Welch | |
| 2003/0134246 | A1 | 7/2003 | Gray et al. | |
| 2003/0162142 | A1 | 8/2003 | Bennetts et al. | |
| 2003/0175148 | A1 | 9/2003 | Kvietok | |
| 2004/0007787 | A1 | 1/2004 | Kvietok | |
| 2004/0009103 | A1 | 1/2004 | Westring | |
| 2004/0009447 | A1 | 1/2004 | Decker | |
| 2004/0016818 | A1 | 1/2004 | Murdell | |
| 2004/0028551 | A1 | 2/2004 | Kvietok | |
| 2004/0029061 | A1 | 2/2004 | Dibnah et al. | |
| 2004/0033171 | A1 | 2/2004 | Kvietok | |
| 2004/0033463 | A1 | 2/2004 | Pesu et al. | |
| 2004/0128879 | A1 | 7/2004 | Lu | |
| 2004/0160764 | A1 | 8/2004 | Lee | |
| 2004/0223871 | A1 | 11/2004 | Woo | |
| 2004/0223943 | A1 | 11/2004 | Woo | |
| 2004/0229180 | A1 | 11/2004 | Furner | |
| 2004/0241053 | A1 | 12/2004 | Thompson | |
| 2004/0265164 | A1 | 12/2004 | Woo | |
| 2005/0019238 | A1 | 1/2005 | Hart et al. | |
| 2005/0037306 | A1 | 2/2005 | Nakatsu | |
| 2005/0079463 | A1 | 4/2005 | Yu | |
| 2005/0227190 | A1 | 10/2005 | Pappas | |
| 2006/0057521 | A1 | 3/2006 | Kubicek et al. | |
| 2006/0057522 | A1 | 3/2006 | Kubicek et al. | |
| 2006/0057523 | A1 | 3/2006 | Kubicek et al. | |
| 2006/0057526 | A1 | 3/2006 | Kubicek et al. | |
| 2006/0057528 | A1 | 3/2006 | Kubicek | |
| 2006/0057529 | A1 | 3/2006 | Kubicek et al. | |
| 2006/0084021 | A1 | 4/2006 | Kubicek | |
| 2006/0183065 | A1 | 8/2006 | Konkle, Jr. | |

FOREIGN PATENT DOCUMENTS

| | | |
|---|---|---|
| DE | 24 40 068 | 3/1976 |
| DE | 3302591 | 8/1984 |
| DE | 3403604 | 8/1985 |
| DE | 4203644 | 8/1993 |
| DE | 4241292 | 5/1994 |
| DE | 4314122 | 11/1994 |
| DE | 195 48 958 | 5/1996 |
| DE | 195 08 962 | 9/1996 |
| DE | 102004011919 | 6/2005 |
| EP | 0146247 | 6/1985 |
| EP | 1054054 | 11/2000 |
| EP | 1 336 799 | 8/2003 |
| FR | 2628825 | 3/1988 |
| GB | 161342 | 4/1921 |
| GB | 1514338 | 6/1978 |
| GB | 2 239 942 | 7/1991 |
| JP | 362220594 | 9/1987 |
| JP | 406212189 | 8/1994 |
| JP | 408185710 | 7/1996 |

| | | |
|---|---|---|
| JP | 2003-213292 | 7/2003 |
| WO | WO 89/06141 | 7/1989 |
| WO | WO 95/12783 | 5/1995 |
| WO | WO 96/02794 | 2/1996 |
| WO | WO 99/17055 | 4/1999 |
| WO | WO 99/45322 | 9/1999 |
| WO | WO 01/46618 | 6/2001 |
| WO | WO 2004/008026 | 1/2004 |
| WO | WO 2004/083349 | 9/2004 |
| WO | WO 2004/083718 | 9/2004 |
| WO | WO 2004/090417 | 10/2004 |

OTHER PUBLICATIONS

Pourette Catalog 1998; p. 12.
Prices London Candlemakers; http:www.prices-candles.co.uk/mainpage.htm; 1 page, printed Apr. 21, 2005.
Prices London Candlemakers; http:www.prices-candles.co.uk/catalogue/Accessories/Accessories%20Page%2008.jpg; 1 page; printed Apr. 21, 2005.
Two (2) photos of Price's "Coral Bay Fragranced Bathroom" product taken Jan. 1, 1999.
Stephanie Reiser Wrought Iron—"Welcome to CourtingCandle.com!" http://www/courtingcandle.com; 1 page printed on May 12, 2004.
Intl. Search Report dated Oct. 13, 2006, Appl. No. PCT/US 2006/020218.
Intl. Search Report dated Jul. 27, 2006, Appl. No. PCT/US 2005/032266.
U.S. Appl. No. 09/742,631, Office Action dated Aug. 18, 2003.
U.S. Appl. No. 09/747,525, Office Action dated Sep. 9, 2003.
U.S. Appl. No. 09/747,525, Office Action dated May 20, 2003.
U.S. Appl. No. 09/747,525, Office Action dated Jan. 10, 2003.
U.S. Appl. No. 09/747,525, Office Action dated Jul. 2, 2002.
U.S. Appl. No. 09/747,525, Office Action dated Oct. 1, 2001.
U.S. Appl. No. 10/780,028, Office Action dated Oct. 4, 2006.
U.S. Appl. No. 10/780,028, Office Action dated Apr. 11, 2006.
U.S. Appl. No. 10/780,028, Office Action dated Oct. 18, 2005.
U.S. Appl. No. 10/938,434, Office Action dated Jul. 17, 2006.
U.S. Appl. No. 10/938,434, Final Office Action dated Nov. 20, 2006.
U.S. Appl. No. 10/978,744, Office Action dated Jul. 19, 2006.
U.S. Appl. No. 10/978,646, Office Action dated Aug. 3, 2006.
U.S. Appl. No. 10/978,744, Office Action dated Nov. 13, 2006.
PCT Intl. Search Report and Written Opinion dated Nov. 29, 2006, Appl. No. PCT/US2006/031139.
Intl. Search Report and Written Opinion dated Mar. 13, 2007, Appl. No. PCT/US2006/042787.
Intl. Search Report and Written Opinion dated Mar. 21, 2007, Appl. No. PCT/US2006/046057.
U.S. Appl. No. 11/123,372, Office Action dated Feb. 27, 2007.
U.S. Appl. No. 11/124,313, Office Action dated Feb. 28, 2007.
U.S. Appl. No. 11/123,461, Office Action dated Mar. 7, 2007.
U.S. Appl. No. 11/123,809, Office Action dated Mar. 7, 2007.
U.S. Appl. No. 10/978,646, Office Action dated May 4, 2007.
Office Action dated May 4, 2007, U.S. Appl. No. 10/978,646.

* cited by examiner

CANDLE ASSEMBLY INCLUDING A FUEL ELEMENT AND A WICK HOLDER

CROSS REFERENCE TO RELATED APPLICATIONS

This application is a continuation-in-part of U.S. patent application Ser. No. 10/780,028, filed Feb. 17, 2004 now U.S. Pat. No. 7,247,017, which is incorporated herein by reference in the entirety thereof.

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates generally to candle assemblies, and more particularly to candle assemblies including a capillary path disposed between a wick and a support for a fuel charge.

2. Description of the Background of the Invention

In many common candle assemblies, melted fuel from a fuel charge surrounding a wick is drawn upwardly through the wick to a burning flame thereon by capillary action. One such candle assembly is a basic taper or pillar candle having a charge of substantially solidified candle wax disposed around and supporting a fibrous wick, such as a cotton string. A flame on the wick melts adjacent candle wax, which is drawn through the wick toward the flame and consumed thereby. As the wax adjacent the flame is consumed, the top portion of the wick is also consumed, and the flame moves downwardly with, or follows, the level of the wax.

Some candle assemblies provide a substantially stationary flame to provide a constant aesthetic or functional configuration. One such candle assembly is a wax fuel charge that is carried within a housing and urged upwardly by a spring toward a stationary wick. The wick is secured through an opening in a cover plate attached to the housing by a metal coil and touches the top of the fuel charge. When the wick is lit above the cover plate, heat is conducted through the coil to melt the top portion of the fuel charge, and the melted wax is drawn up the wick to feed the flame. As the top portion of the fuel charge is consumed, the spring urges the remaining portion of the fuel charge toward the wick to continuously provide fuel thereto until the fuel charge is completely consumed.

Another candle assembly is a container candle having a candlewick holder and a candlewick encased within a fuel charge. The candlewick holder has vertical support member projecting upwardly between opposing horizontal feet members. A lower end of the wick is retained in a ring formed by opposing sides of the vertical support member. The lower end of the wick is spaced from the feet by spacers disposed between the ring and the feet. The feet are disposed on a bottom wall of a container for the fuel charge, and the support member holds the wick upright when the fuel reaches a level of the candlewick holder. A flame on the wick will extinguish when the fuel level is physically lower than the lower end of the wick because the fuel is no longer in contact with the wick.

Other candle assemblies include a wick holder attached to a bottom end of a wick to help retain the wick in a desired position embedded within a solid fuel charge. In one such assembly, the wick extends upwardly from a receiver barrel, which extends upwardly from a base plate of a wick holder. The wick and the wick holder are embedded within a solid fuel charge contained within a can. The base plate rests directly on and is circumferentially encompassed by a top wall of a pedestal, which projects upwardly from a bottom wall of the can. When the level of wax in the candle assembly drops below the top wall of the pedestal, a flame on the wick is extinguished because of a lack of fuel, thereby leaving a pool of unconsumed fuel in the bottom of the can.

In another candle assembly, a wick is carried within a wick holder having a frustoconical peripheral base wall extending downwardly therefrom. A bottom end of the wick is retained within the confines of the peripheral base wall, and a sealant or closure encases the bottom end of the wick to prevent liquid fuel from reaching the bottom end of the wick from underneath the peripheral skirt. A flame on the wick extinguishes automatically when the fuel drops below an exposed portion of the wick due to a lack of fuel.

Yet another candle assembly provides a wax charge contained within a shaped metal can with a wick extending from a top surface of the wax charge to a bottom wall of the can. A dome is formed in the bottom wall, and a dished depression at an apex of the dome receives a wick clip disposed at a bottom end of the wick. A smaller recess in the dish shaped recess is disposed directly under the wick. When the wax is melted at the level of the dish shaped depression, liquefied fuel is drawn under the wick clip into the second smaller depression under the wick to provide a supply of liquefied fuel at a bottom end of the wick. When the top surface of the melted wax falls below the level of the dish shaped recess, a flame on the wick is automatically extinguished due to a lack of fuel supply to the wick, thereby leaving a pool of unconsumed fuel in the bottom of the can.

In yet other candle assemblies, a wick holder for a candle is made of a thermally resistant flame retardant material and has a wick disposed in a bore and spaced above a bottom support surface for a wax fuel element. A frustoconical peripheral skirt extends downwardly from the bore, and the bottom end of the wick terminates in the space surrounded by the peripheral skirt spaced above the bottom support surface. When an upper level of the wax surrounding the wick is burned down to the upper level of the wick holder, the flame is extinguished due to lack of fuel supply and due to the flame retardant material.

SUMMARY OF THE INVENTION

According to one aspect of the invention, a wick holder adapted to retain a wick includes a base portion, and a capillary path disposed in the base portion. The capillary path is adapted to transfer liquid from a pool of liquid fuel disposed about the base portion to the wick by capillary action therein.

According to another aspect of the invention, a fuel element includes a fuel charge having a bottom surface, a wick disposed in the fuel charge, the wick being spaced from the bottom surface, and a wick holder holding the wick. The wick holder includes a base portion disposed between the bottom support surface and the wick. A capillary path is defined in the base portion and provides fluid communication between the bottom surface and the wick.

According to a further aspect of the invention, a candle assembly includes a melting plate adapted to retain a pool of liquid fuel thereon, and a wick holder carrying a wick disposed in a fuel charge with the wick spaced above the melting plate. The wick holder includes a base portion disposed between the wick and the melting plate and a capillary path defined in the base portion. The capillary path is adapted to transfer liquid from the pool to the wick by capillary action therein.

Other aspects of the present invention will become apparent upon consideration of the following detailed description.

DETAILED DESCRIPTION

In one embodiment of the present invention, a melting plate candle assembly includes a melting plate carried by a support base and a fuel element disposed on the melting plate. The fuel element includes a fuel charge surrounding a wick carried by a wick holder. A capillary lobe disposed at a low point on the melting plate engages and/or positions the wick, wick holder, and fuel charge in such a manner as to provide an advantageous positioning thereof for quickly melting the fuel charge, as well as to create a capillary flow of liquefied or melted fuel from a pool formed on the melting plate to the wick positioned above the melting plate in the wick holder, which in one operative embodiment is placed in such close relationship to the capillary lobe as to create a very narrow gap, or capillary space, between the lobe and the wick holder. The capillary space, which may be for example from approximately 0.01 to about 0.04 inches (0.2-1.0 mm), or about 0.02 inches (0.5 mm), allows liquefied fuel to be drawn by capillary action to the wick for consumption by a flame. In another embodiment of the invention, the capillary action may also or alternatively be the result of grooves cut in the lobe, or in the wick holder, in which later case the capillary lobe may be omitted or may simply serve as a locating member to help properly position the fuel element on the melting plate without necessarily forming a capillary space. The wick holder may be held away from the lobe by the presence of appropriately positioned and sized bumps located on the lobe, the wick holder, and/or the melting plate. Moreover, the capillary forming combination of elements may constitute a concave depression in the melting plate, rather than a raised male lobe, and the wick holder in such case may be an appropriately shaped male member, which fits closely within the depression so as to create a capillary gap between the members, by which fuel is fed to the wick. Still further, it is contemplated that the capillary lobe, either in a male configuration or in a female configuration, need not constitute a raised circular member, but may be of any shape, such as for example cylindrical, pyramid shaped, square, oval, triangular, or any other desired shape, in combination with a like-shaped and appropriately dimensioned wick holder. Also, the capillary lobe need not transmit liquid fuel to the wick at all parts of the perimeter of the capillary lobe. For example, a circular capillary lobe in conjunction with a circular wick holder may create a capillary gap for a limited portion of its circumference, such as, for example, 90, 180, or 270 degrees, or other portions thereof. Thus, the wick holder in one embodiment is in proximity to the lobe throughout the total area of engagement therewith to provide a substantially full capillary effect, and in another embodiment is in proximity to the lobe only in sufficient area to provide an adequate flow of fuel to the wick to maintain the flame thereon.

Figure 1:
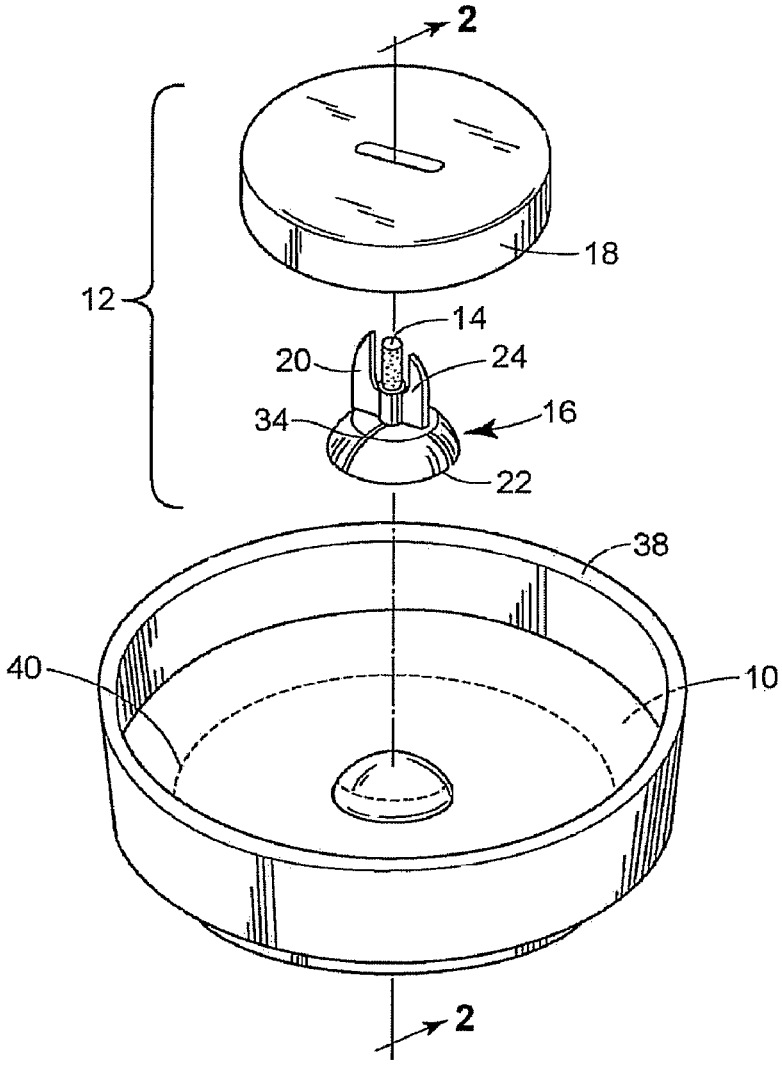
FIG. 1 is a partially exploded isometric view of a candle assembly according to one embodiment of the present invention.
Figure 2:
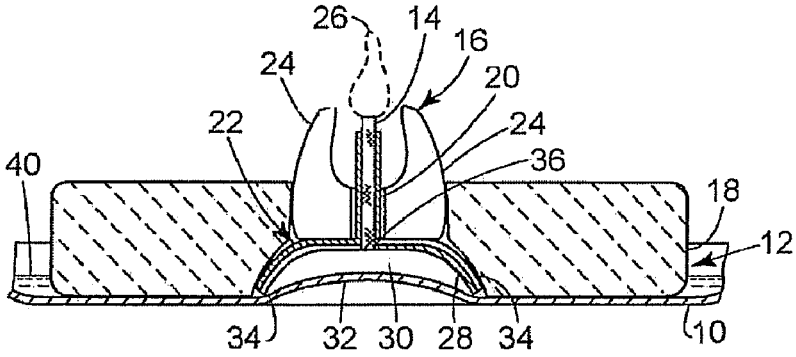
FIG. 2 is partial cross-sectional view generally along the lines 2-2 in FIG. 1 of the candle assembly in an operative position.
Figure 3:
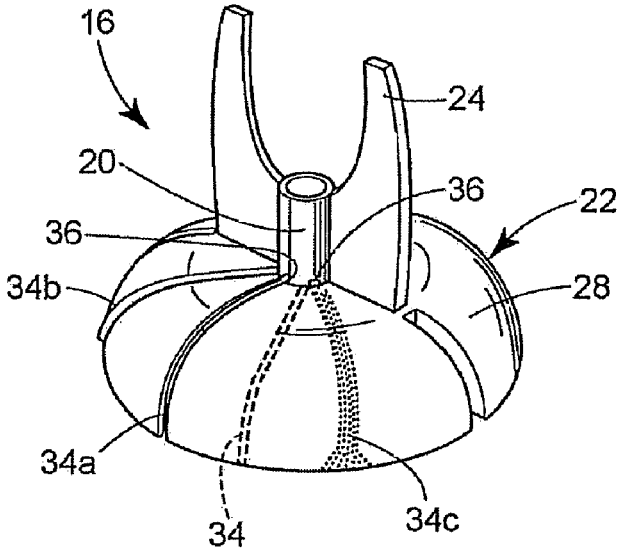
FIG. 3 is an isometric view of a wick holder shown in FIG. 1.

Turning now to the drawings, FIGS. 1-3 show an embodiment of the present invention that includes a melting plate 10 and a fuel element 12 adapted for use in conjunction with the melting plate. The fuel element 12 includes a wick 14 carried by a wick holder 16 and surrounded by a fuel charge 18, such as candle wax. Volatile actives, such as fragrances and/or insect repellants, are carried by the fuel charge 18 in one embodiment. The wick holder 16 has a wick receiver 20, such as an elongate tube, extending upwardly from a base portion 22 and heat transmissive elements, such as heat fins 24, extending upwardly along the wick 14. The wick 14 is disposed within the wick receiver 20 such that an upper end thereof extends above the fuel charge 18 to form a location where a flame 26 would normally be lit, and a lower end thereof is disposed proximate the base portion 22. In this embodiment, the lower end of the wick is spaced above the melting plate a distance sufficient to prevent direct capillary flow between the wick and the melting plate. For example, in one embodiment, the wick may be spaced above the melting plate a distance greater than approximately 0.04 inches (1.0 mm), and in another embodiment may be spaced approximately 0.5 inches (12 mm) above the melting plate. In other embodiments, the lower end of the wick may be spaced above the melting plate a distance sufficient to allow direct capillary flow therebetween or the wick may directly engage the melting plate. The heat fins 24 extend between positions adjacent the location on the wick 14 where the flame 26 would normally be lit and positions surrounded by the fuel charge 18. Heat from the flame 26 is conducted to the fuel charge 18 through the heat fins 24 to accelerate initial melting of the fuel charge in conjunction with melting caused by convection. In one embodiment, the entire wick holder 16 is composed of heat conductive material, such as aluminum and/or other metals. The base portion 22 in one embodiment is defined substantially by a peripheral wall 28 extending away from the wick receiver 20, which forms a cavity 30 opposite the wick receiver into which a locating member 32 may be received. Capillary paths 34, such as channels, are disposed in or defined by the peripheral wall 28 of the base portion so as to enable capillary flow of liquid therethrough without the aid of a capillary lobe. The capillary paths 34 may be formed on an inner surface and/or an outer surface of the peripheral wall 28 and extend to the wick 14. The capillary paths 34 may also or alternatively be formed within the peripheral wall 28. As shown in detail in FIG. 3, the capillary paths 34 may have different forms, such as an open channel 34*a*, an enclosed tube 34*b*, a roughened surface 34*c* forming a series of interconnected capillary spaces therein, or any other form capable of drawing liquid toward the wick 14 from the melting plate 10 by capillary action. In one embodiment, the peripheral wall 28 itself may be formed completely or partially of a porous material in which interconnected pore spaces inside the peripheral wall form one or more capillary paths extending between the melting plate 10 and the wick 14 through which liquid fuel may be drawn by capillary action from the melting plate toward the wick. Appropriate openings 36 are disposed in the wick receiver 20 as may be needed to allow fluid flowing up the capillary paths 34 to reach the wick 24.

The melting plate 10 is carried by an appropriate support base 38, which in one embodiment is formed of a substantially non-heat conductive material, such as glass, plastic, and/or ceramic. The melting plate 10 is shaped to retain a pool 40 of liquid, such as melted wax or other liquid fuel material from the fuel charge 18, on a medial portion thereof. In one embodiment, the melting plate 10 is dish-shaped and made of a heat conductive material, such as aluminum, and in other embodiments, the melting plate may be formed of non-heat conductive materials. The locating member 32 is disposed on the melting plate 10 in a region where the pool 40 of liquid is retained, such as a low point thereon.

In operation, the fuel element 12 is disposed on the melting plate 10 with the locating member 32 received within the cavity 30 defined by the base portion 22 of the wick holder 16 and the bottom surface of the fuel charge 18 disposed on the melting plate. The lower end of the wick 14 and the peripheral wall 28 of the base member 22 are spaced above the locating member 32 a distance sufficient to inhibit or prevent substantial capillary flow of liquid between the base member and the locating member. When the flame 26 is lit on the wick 14, the fuel charge 18 is melted to form the pool 40 of molten wax or liquefied fuel on the melting plate 10 about or engaging the base portion 22 of the wick holder 16. As the flame 26 burns, the liquefied fuel is drawn or transferred through the capillary paths 34 in the base portion 22 from the pool upwardly to the wick by capillary flow. Heat conductive material in the melting plate 10 is warmed by heat from the flame 26 and may prevent the pool 40 from solidifying around the edges thereof, thereby facilitating complete or near complete consumption of the fuel charge 18. Further, gentle heating of the pool 40 of melted wax facilitates dispersion of volatile actives from the fuel charge 18 to the surrounding environment.

Figure 4:
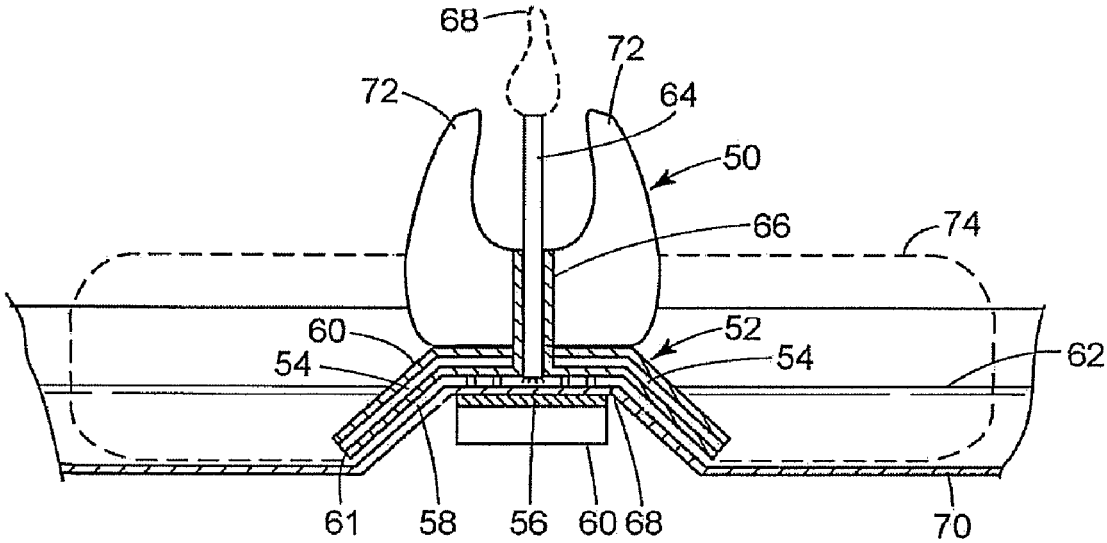
FIG. 4 is a partial cross-sectional view of a candle assembly according to another embodiment of the present invention.

In FIG. 4, another embodiment of the present invention is shown in which a wick holder 50 having a base portion 52 with capillary paths 54 formed therein also interacts with a locating protrusion 56, such as a capillary pedestal, to form a second capillary path, or capillary space 58 defined between the locating protrusion and the base portion. The capillary paths, shown in FIG. 4 as enclosed elongate capillary tubes defined in a peripheral wall 60 of the base portion, extend between a bottom edge 61 of the peripheral wall and a wick 64 disposed in a wick receiver 66. Other forms of capillary paths, such as the capillary paths described previously herein, may also or alternatively be used. Spacers 68 disposed between the base portion 52 and the locating protrusion 56, such as ferrous rivets, protrusions on one or both of the base portion and locating protrusion, and/or raised portions of the capillary paths, for example, may also be used to maintain the capillary space 58. A retention mechanism, such as a magnet 60 disposed under the locating protrusion 56 interacting with the ferrous rivets, an interengaging clip assembly, adhesive, hook and loop fasteners, etc., helps retain the wick holder 50 to the locating protrusion. Liquefied fuel from a pool 62 formed on a melting plate 70 surrounding the locating protrusion 56 may be drawn upwardly toward the wick 64 by capillary action through both the capillary paths 54 and the capillary space 58. Heat conductive elements 72 disposed adjacent a flame 68 on the wick 64, such as heat fins, extend through a portion of a fuel charge 74 to speed melting thereof and initial formation of the pool 62.

Figure 5:
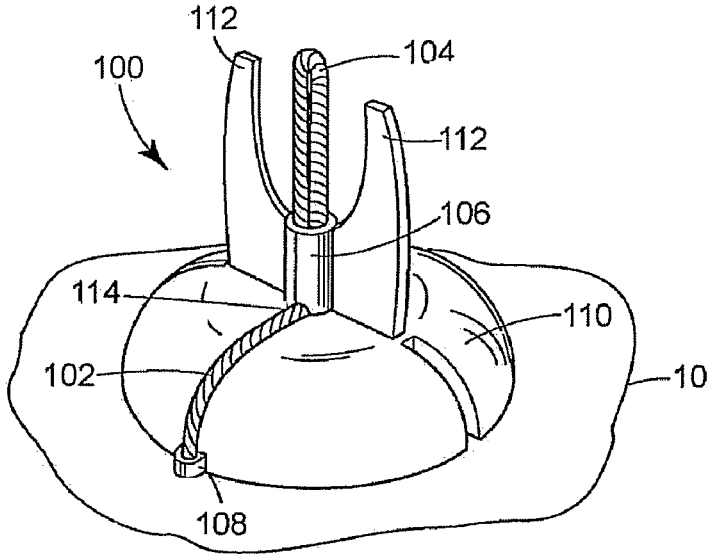
FIG. 5 is an isometric view of a wick holder according to yet another embodiment of the present invention.
Figure 6:
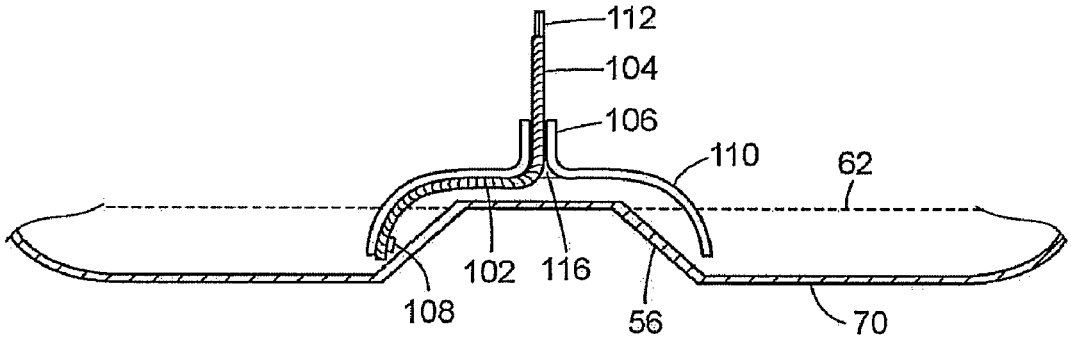
FIG. 6 is a partial cross-sectional view of a wick holder according to a further embodiment of the present invention.

In FIG. 5, another wick holder 100 according to the present invention includes a capillary path that is formed by a second wick section 102 extending between a support surface, such as the melting plate 10 or the melting plate 70, for example, and a primary wick 104, such as the wick 14 or the wick 64, spaced above the support surface. The wick holder 100 includes a wick receiver 106 for retaining the primary wick 104 extending upwardly from a base portion 110 and heat transmissive elements 112, similar to any one of the wick holders described herein above. The second wick section 102 may be separate from the primary wick 104 or may be an extension of the primary wick. In one embodiment, the second wick section 102 extends through an opening 114 in a sidewall of the wick receiver 106 and is disposed along an exterior side of the base portion 110. In another embodiment, shown in FIG. 6, the second wick section 102 extends through an opening 116 in the base portion 110 below the wick receiver 106 and is disposed on an interior side of the base portion. A retention structure disposed on the base portion, such as a clip 108, for example, retains the second wick section 102 against the base portion 110. The second wick section 102 may be any material sufficient to draw liquid fuel, such as from the pool 62 of melted wax disposed on the melting plate 70, by capillary action toward the primary wick 104. In one embodiment, the second wick portion 102 is an extension of the primary wick 104, and in another embodiment is an extension of a porous core section, such as a paper core or a cotton thread, of the primary wick. The second wick section 102 may extend continuously between a bottom edge of the base portion 110 and the primary wick 104 or may extend only partly therebetween.

Figure 7:
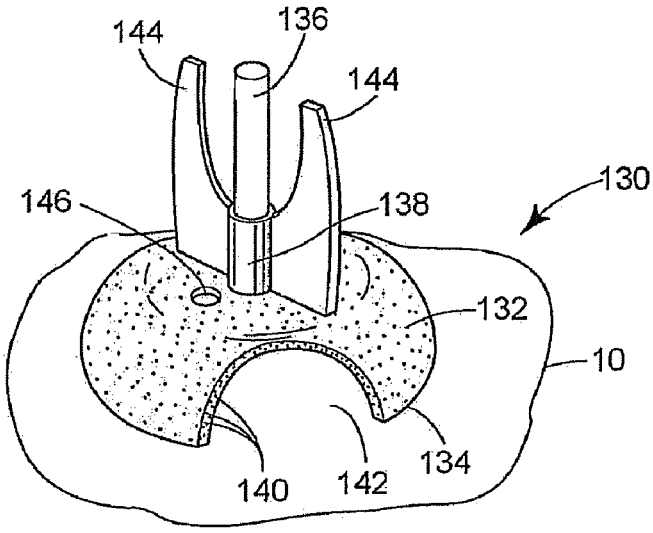
FIG. 7 is an isometric view in partial cross section of a wick holder according to an even further embodiment of the present invention.

In FIG. 7, another embodiment of the present invention includes a wick holder 130 having a base portion including a wall 132 formed of a porous material that defines a capillary path between a bottom end 134 thereof and a wick 136 carried within a wick receiver 138. The wall 132 may be made of any porous material capable of drawing liquid fuel, such as oil or melted wax, from a support surface, such as a melting plate 10, to the wick 136. Some examples of porous materials include paper, foams, porous metals, porous glass, porous ceramics, porous plastics, porous stones, pressed sand, and any other material having a matrix of interconnected spaces or pores 140 through which the liquid fuel may be drawn by capillary action. Preferably, the wick receiver 138, which in this embodiment is a hollow cylindrical tube, retains the wick 136 spaced above a support surface, such as the melting plate 10, a distance sufficient to prevent direct capillary fluid flow between the wick and the support surface. The wall 132 defines a bottom cavity 142, which may be used to receive a locating protrusion, such as the locating protrusion 32. In another embodiment (not shown), the base portion is a solid mass of porous material that does not define a bottom cavity and may define additional capillary channels along an exterior surface or through an interior of the base portion. Heat transmissive elements 144 extend upwardly from the wall 132 on opposite sides of the wick to conduct heat from a flame on the wick into a fuel charge, such as any of the fuel charges 18 and 74 described previously herein. One or more openings 144 through the wall 132 may receive ferro-magnetic rivets for magnetic interaction with a base magnet (not show) as previously describe and/or may allow melted wax from a fuel charge to flow into the cavity 142. When the wick 136 is lit, liquid fuel engaging the wall 132 may be drawn upwardly from the melting plate 10 toward the wick through the capillary path defined by the interconnected spaces or pores 140 to provide a supply of fuel to the flame.

In another embodiment (not shown), a melting plate does not include a locating member, and a base portion of a wick holder does not form a cavity opposite a wick receiver. Rather, the base portion is a substantially solid mass disposed between a lower end of the wick and the melting plate, and capillary paths are disposed along or through the base portion to provide capillary fluid communication between a pool of liquid fuel and the wick spaced above the melting plate. In yet another embodiment (not shown), the locating member may take different forms, such as one or more protrusions, recesses, and/or other structures that engage and provide a defined location for the wick holder 16 on the melting plate 10.

INDUSTRIAL APPLICABILITY

A wick holder of the present invention having capillary paths is capable of providing capillary fluid flow from a pool of liquid fuel on a support surface, such as a melting plate, to a wick spaced above the melting plate without precise interaction between a capillary lobe and a base portion of the wick holder. Thus a candle assembly employing a wick holder of the present invention may in some embodiments be more efficient in melting and/or consuming a fuel charge as opposed to a wick holder without such capillary paths. Further, a candle assembly as described herein provides a substantially stationary flame spaced above a pool of heated fuel, which might have volatile actives contained therein, at a distance that may be sufficient to maintain the pool below a selected maximum temperature and above a melting temperature of the fuel.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications within the scope of the impending claims are reserved.

I claim:

1. A wick holder adapted to retain a wick, comprising:

a base portion; and a capillary path defined in the base portion, wherein the capillary path is adapted to transfer liquid from a pool of liquid fuel disposed about the base portion to the wick by capillary action therein distinct from any capillary action through wick, and a wick receiver extending from the base portion, the wick receiver adapted to receive the wick and maintain the wick spaced apart from the pool of liquid fuel, the base portion comprising a peripheral wall defining a substantially non-capillary cavity opposite the wick receiver, wherein the capillary path is at least partly defined in the peripheral wall.

2. The wick holder of claim 1, wherein the capillary path is defined along a surface of the peripheral wall.

3. The wick holder of claim 1, wherein the wick receiver comprises an elongate tube.

4. The wick holder of claim 1, wherein the capillary path comprises an elongate tube.

5. The wick holder of claim 1, wherein the capillary path comprises an elongate open channel.

6. The wick holder of claim 1, wherein the capillary path comprises a plurality of inter-connected capillary spaces.

7. The wick holder of claim 1, wherein the capillary path comprises a porous section of the base portion.

* * * * *